United States Patent [19]

Anderson

[11] Patent Number: 4,999,593

[45] Date of Patent: Mar. 12, 1991

[54] CAPACITIVELY COMPENSATED MICROSTRIP DIRECTIONAL COUPLER

[75] Inventor: Dale R. Anderson, Fort Worth, Tex.

[73] Assignee: Motorola, Inc., Schaumburg, Ill.

[21] Appl. No.: 360,668

[22] Filed: Jun. 2, 1989

[51] Int. Cl.[5] ..... H01P 5/18

[52] U.S. Cl. ..... 333/112; 333/116

[58] Field of Search ..... 333/109, 112, 115, 116, 333/161

[56] References Cited

U.S. PATENT DOCUMENTS

| | | | |
|---|---|---|---|
| 3,967,220 | 6/1976 | Tagashira | 333/109 X |
| 4,158,184 | 6/1979 | Kenyon | 333/109 X |
| 4,216,446 | 8/1980 | Iwer | 333/116 X |
| 4,482,873 | 11/1984 | Nyhus | 333/116 |

FOREIGN PATENT DOCUMENTS

| | | | |
|---|---|---|---|
| 470025 | 8/1975 | U.S.S.R. | 333/109 |

*Primary Examiner*—Paul Gensler

*Attorney, Agent, or Firm*—Michael J. Buchenhorner

[57] ABSTRACT

A microstrip capacitively-compensated directional coupler with improved directivity and decreased coupling length. The directional coupler of the invention includes a primary transmission line, having a first port and a second port and a secondary transmission line electromagnetically coupled to the first line. The secondary transmission line has a third port and a fourth port. The invention also calls for a first reactive coupling network disposed between the first port and the third port, and a second reactive coupling network disposed between the second port and the fourth port. Those reactive couplings improve the directivity of the coupler and foreshorten its coupling length. The invention also calls for a phase-shifting line for shifting the phase of the coupled signal. The phase-shifting line further foreshortens the required coupling length for the coupler.

8 Claims, 2 Drawing Sheets

CAPACITIVELY COMPENSATED MICROSTRIP DIRECTIONAL COUPLER

BACKGROUND OF THE INVENTION

1. Technical Field of the Invention

This invention relates generally to microstrip directional couplers.

2. Description of the Prior Art

Known microstrip directional couplers typically use structures that obtain flatter coupling versus frequency characteristics at the expense of using greater dimensions to accomplish such characteristics. An example, representative of such known directional couplers is the full quarter-wave quasitransverse electromagnetic wave directional coupler. Such a directional coupler, implemented at very high frequency (VHF) on a glass-/epoxy printed circuit board requires a coupled region length equal to one foot, which is impractically long for use in power amplifiers. A smaller directional coupler implementation would require forward and reflected port compensation to realize the desired flat coupling response versus frequency characteristic. Moreover, that type of compensation generally results in coupled port mismatching that degrades the directivity (approximately −12 decibels, dB, at VHF) of an uncompensated coupling structure.

Another problem that is common in known VHF microstrip directional couplers is poor directivity. Directivity is a measure of undesirable coupling from a forward port to a reverse port when the forward port is energized. In an ideal four-port backward wave directional coupler, all of the power applied into a primary forward port would appear at the secondary forward port and no power would appear at the secondary reverse port. In such an ideal directional coupler, the directivity would be infinite.

In known microstrip directional couplers, the directivity is poor because the energy above the microstrip structure (the dielectric above the structure being air) propagates faster along the coupler than does the energy propagating in the printed circuit (pc) board substrate. Typical directivity performance for microstrip couplers is 7–13 dB, depending on the coupling and on the frequency of operation. If such a directional coupler is used in a power control loop to sense the forward and reflected power into a load, its directivity will limit the minimum voltage standing wave ratio (VSWR) of the load which can be resolved, as well as power leveling performance into a VSWR.

Prior attempts by those skilled in the art to improve the directivity of directional couplers include the addition of a dielectric overlay, modification of the coupled line shape or the addition of a single, lumped capacitor which bridges each end of the coupled structure. Each of those techniques improves the directivity of tightly-coupled (i.e., less than −10 dB), quarter-wave coupled lines to about −20 dB. However, those techniques become ineffective or impractical to implement when the value coupling is less than −20 dB or when the coupled structure is significantly less than a quarter wavelength long.

SUMMARY OF THE INVENTION

Accordingly, it is an object of the present invention to provide a directional coupler that overcomes the problems of the prior art.

Briefly, according to the invention, a microstrip directional coupler is formed on a printed circuit board having a primary transmission line with first and second ports and a secondary transmission line with third and fourth ports, (or simply a conductor) electromagnetically coupled to the primary transmission line. One aspect of the invention improves the directivity of a directional coupler by providing reactive couplings: (1) between the first port and the third port (i.e., the forward ports), and (2) between the second port and the fourth port (i.e., the reverse, or reflection, ports). Those reactive couplings transform the potentials at the first and second ports to potentials at the third and fourth ports, respectively. Thus, the directivity of the directional coupler of the invention is improved over that obtained with known directional couplers.

DESCRIPTION OF THE PREFERRED EMBODIMENT

Figure 1:
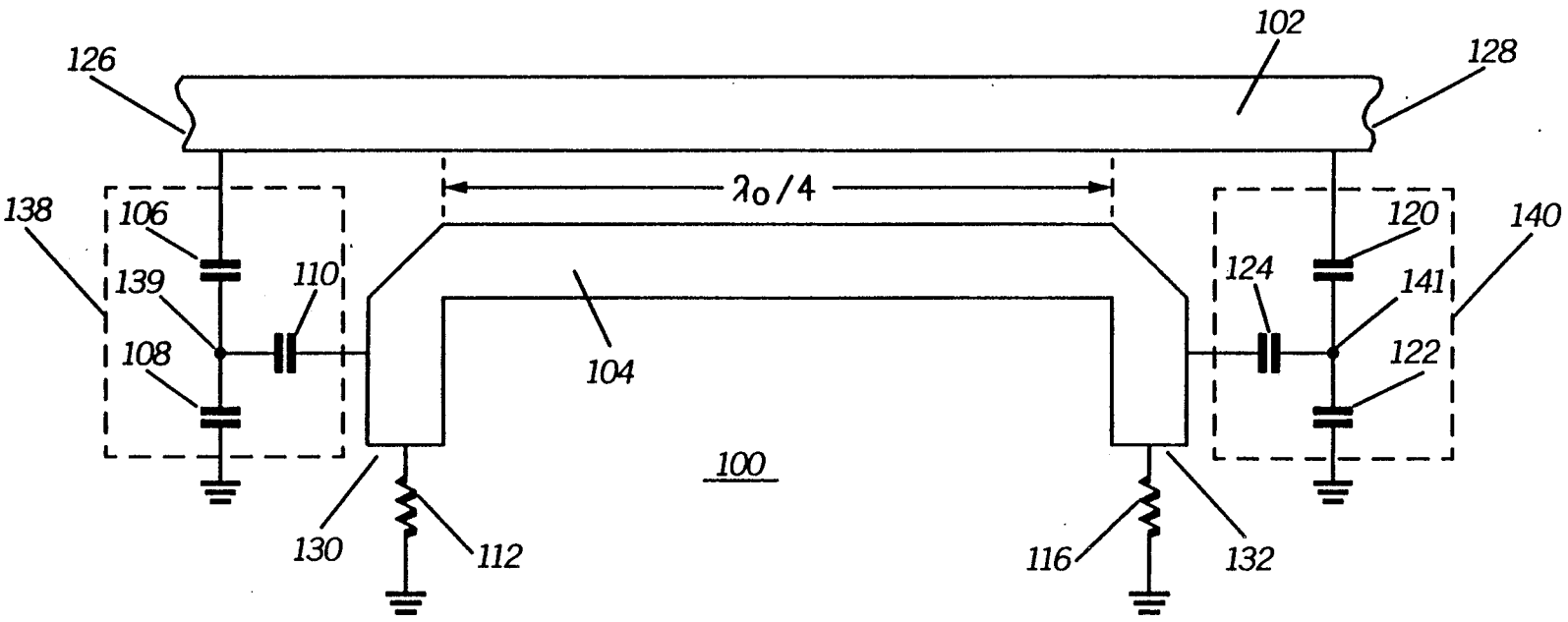
FIG. 1 is a diagram of a microstrip directional coupler having capacitive couplings, illustrative of the present invention.

Referring to FIG. 1, there is shown a capacitively-compensated microstrip directional coupler. The directional coupler, indicated generally by numeral 100, comprises a through (or primary) transmission line 102, having a first port 126 at one end and a second port 128 at the opposite end. The first port is a forward port because the forward component of a signal is applied at that point. Such a signal could be supplied by a power amplifier in a radio transmitter. The second port 128 is a reverse port because it receives a reverse (or reflected) signal.

In the preferred embodiment, the directional coupler also comprises a second transmission line 104, electromagnetically coupled, (on its edge) to the first transmission line. The second transmission line 104 has a third port 130 at one end and a fourth port 132 at the opposite end. The level of the signal at the third port 130 is representative of the relative level of the signal at the first port 126 and the level of the signal at the fourth port 132 is representative of the relative level of the signal at the second port 128.

The first port 126 is preferably coupled to the third port 130 by a first reactive coupling network 138 comprising a capacitor 106 coupled from the first port 126 to a node 139. The reactive coupling network 138 further comprises a second capacitor 108, coupled between node 139 and ground potential, and a third capacitor 110, coupled between the node 139 and the third port 130.

Similarly, a second reactive coupling network 140 couples the second port 128 to the fourth port 132. The second reactive coupling network 140 comprises a fourth capacitor 120 coupled between the second port 128 and a node 141. The second reactive coupling network 140 further comprises a fifth capacitor 122 coupled between the node 141 and ground potential, and a sixth capacitor 124, coupled between the node 140 and the fourth port 132.

A resistor 112 represents the load between the third port 130 and ground potential. Similarly, a resistor 116 represents the load between the fourth port 132 and ground potential.

When electric power is applied to the forward port 126 power is induced at the coupled port 130. The measure of the power coupled to coupled port 130 when driving forward port 126 is called "the coupling", and is expressed mathematically below:

$$C = 10 \log (P3/P1) \text{ dB} \quad (1)$$

Where P3 represents the power coupled to the third port 130 and P1 is the power applied to the first port 126. Use of the network comprising the capacitors 106, 108, and 110 increases the value of C over what could be obtained if there were no capacitive coupling introduced between the first port 126 and the third port 130.

Directivity is a measure of undesirable coupling of power to the fourth port when applying power to (i.e. driving) the first port 126, and is shown below:

$$D = 10 \log (P4/P3) \text{ dB} \quad (2)$$

If the directional coupler of FIG. 1 were a perfect (or ideal) backward wave coupler, all of the coupled power from the first port 126 would appear at the third port 130 and no power would appear at the fourth port 132. Under such conditions, the directivity (D) would be infinite.

However, the directional coupler of FIG. 1 without capacitive compensation has rather poor directivity. Such poor directivity is caused by the fact that the power driven into the first port 126 travels faster along the top of the coupler structure than the power propagating inside the substrate does. Typical directivity performance for microstrip couplers is 7–13 dB, depending on the coupling and on the frequency of operation. In accordance with the invention, the directional coupler shown in FIG. 1 uses capacitive compensation to improve the directivity of a microstrip coupler, having −25 dB coupling, to greater than −30 dB over a wide bandwidth. Addition of the capacitive compensation also increases the effective electrical length of the coupling structure. Thus, the invention realizes the coupling properties of a full quarter wavelength structure at approximately one-half the quarterwave wavelength frequency as built, at UHF.

In the preferred embodiment, a radio frequency (RF) signal is applied to the first port 126 in the through line 102. The RF signal is electromagnetically coupled to the third port 130. As discussed previously, the addition of the capacitive network 138 comprising capacitors 106, 108 and 110 improves the coupling and the directivity of the directional coupler 100, as does the capacitive network 140 comprising capacitors 120, 122, and 124.

Figure 2:
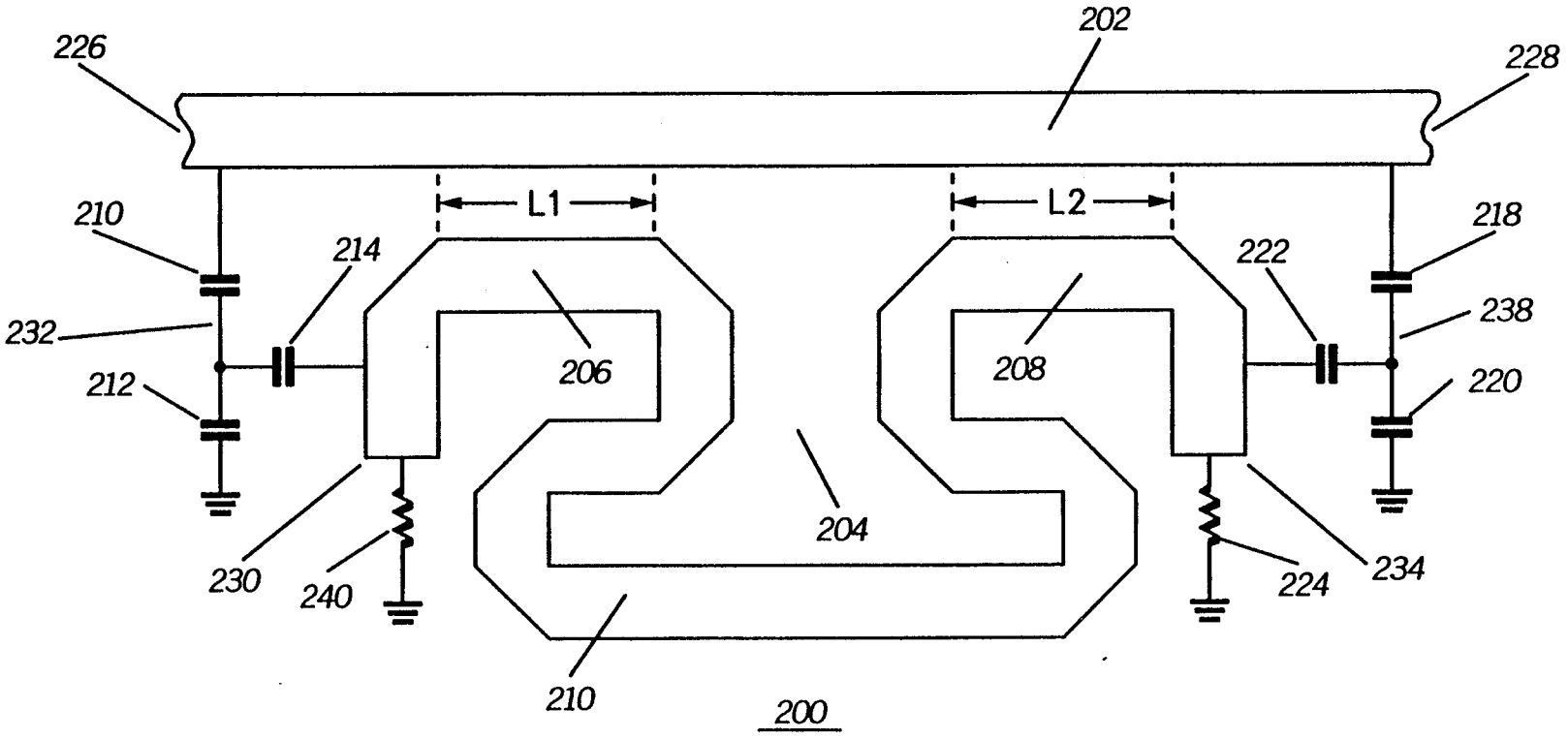
FIG. 2 is a diagram of a microstrip directional coupler, including a phase-shift line.

Referring to FIG. 2, a directional coupler 200 is shown. A primary transmission line 202 has a first (forward) port 226 and a second (reverse) port 228. A secondary transmission line 204, electromagnetically coupled to the primary transmission line 202, has a third port 230 and a fourth port 234. The secondary transmission line 204 comprises a first line segment 206, a second line segment 208, and a phase-shifting line 210 (shown in FIG. 2), disposed between the first line segment 206 and the second line segment 208. The length of the line segment 206 is $L_1$, the length of the line segment 208 is $L_2$, and the length of the phase-shifting line 210 is $L_3$. The total length of the secondary transmission line 204 is $L_t$, where $L_t$ equals the sum of $L_1$, $L_2$, and $L_3$. The characteristic impedance ($Z_{01}$) of the primary transmission line 202 is not necessarily equal to the impedance ($Z_{02}$) of the secondary transmission line.

A capacitive network 232, comprising capacitors 212, 214, and 210 is disposed between the first port 226 and the third port 230, in the same configuration as described with respect to FIG. 1. Similarly, a capacitive network 238, comprising capacitors 218, 220, and 222 is disposed between the second port 228 and the fourth port 234. Again, the capacitors 218, 220, and 222 are coupled in the same configuration as the capacitive network disposed between the second port 128 and the fourth port 132 of the directional coupler of FIG. 1.

A resistor 240, disposed between the third port 230 and ground potential, represents the load on the third port 230. Similarly, a resistor 224, disposed between the fourth port 234, and ground potential represents the load on the fourth port 234.

The phase-shifting line segment 210 shifts the phase of signals coupled along the line segment 206 and the line segment 208, to achieve the forward coupling characteristics of a full quarter-wave structure, even though the sum of lengths $L_1$ and $L_2$ is much smaller than a quarter wavelength (of an electromagnetic wave). As previously discussed, the inclusion of the capacitive networks 232 and 238 at each end of the directional coupler 200 improves the coupler's directivity, as well as foreshortening the coupler.

The total physical length ($L_t$) for a directional coupler practicing the invention is six inches, while the length $L_1+L_2$, is two inches. As previously discussed, a quarter wave uncompensated microstrip directional coupler would be approximately 12 inches long.

I claim as my invention:

1. A directional coupler comprising:

a first transmission line having a first port and a second port;

a conductor electromagnetically coupled to the first line, said conductor having a third port and a fourth port;

a first reactive coupling network coupled between the first port and the third port, further comprising:

a first reactive element, having a first terminal and a second terminal, said first terminal being coupled to the first port;

a second reactive element, having a first terminal and a second terminal, said first terminal being coupled to the second terminal of the first reactive element at a first common node and said second terminal being coupled to ground potential;

a third reactive element, said third reactive element being disposed between the first common node and the third port.

2. The directional coupler of claim 1, further comprising:

a second reactive coupling network between the second port and the fourth port further comprising:

a fourth reactive element, having a first terminal and a second terminal, said first terminal being coupled to the second port;

a fifth reactive element, having a first terminal and a second terminal, said first terminal being coupled to the second terminal of the fourth reactive element at a second common node and said second terminal being coupled to ground potential;

a sixth reactive element disposed between the second common node and the fourth port.

3. The directional coupler of claim 2, wherein the first transmission line is a microstrip line.

4. The directional coupler of claim 3, wherein the ground potential is the potential of the microstrip ground.

5. A directional coupler comprising:

a first transmission line, having a first port and a second port, for receiving a signal; a second transmission line electromagnetically coupled to the first transmission line, said second transmission line comprising a third port, a fourth port, and a phase-shifting segment for shifting the phase of the signal received by the first transmission line, said phase-shifting portion being disposed between the third port and the fourth port;

a first reactive coupling network coupled between the first port and the third port, further comprising:

a first reactive element, having a first terminal and a second terminal, said first terminal being coupled to the first port;

a second reactive element, having a first terminal and a second terminal, said first terminal being coupled to the second terminal of the first reactive element at a first common node and said second terminal being coupled to ground potential; and a third reactive element, said third reactive element being disposed between the first common node and the third port.

6. The directional coupler of claim 5, further comprising:

a second reactive coupling network between the second port and the fourth port further comprising:

a fourth reactive element, having a first terminal and a second terminal, said first terminal being coupled to the second port;

a fifth reactive element, having a first terminal and a second terminal, said first terminal being coupled to the second terminal of the fourth reactive element at a second common node and said second terminal being coupled to ground potential; and a sixth reactive element disposed between the second common node and the fourth port.

7. The directional coupler of claim 6, wherein the first transmission line is a microstrip line.

8. The directional coupler of claim 7, wherein the ground potential is the potential of the microstrip ground.

* * * * *